US006904898B1

(12) United States Patent
Sahlén

(10) Patent No.: US 6,904,898 B1
(45) Date of Patent: Jun. 14, 2005

(54) METHOD AND ARRANGEMENT FOR REDUCING PARTICULATE LOAD IN AN EGR COOLER

(75) Inventor: Ivar Sahlén, Ockero (SE)

(73) Assignee: Volvo Lastyagnar AB, Göteborg (SE)

( * ) Notice: Subject to any disclaimer, the term of this patent is extended or adjusted under 35 U.S.C. 154(b) by 0 days.

(21) Appl. No.: 10/605,105

(22) Filed: Sep. 9, 2003

(51) Int. Cl.[7] ..... F02M 25/07
(52) U.S. Cl. ..... 123/568.12; 60/605.2
(58) Field of Search ..... 123/568.11, 568.12, 123/563; 60/599, 605.2, 278, 279

(56) References Cited

U.S. PATENT DOCUMENTS

| | | | | | |
|---|---|---|---|---|---|
| 5,669,365 | A | * | 9/1997 | Gartner et al. | 123/568.12 |
| 5,785,030 | A | * | 7/1998 | Paas | 123/568.12 |
| 6,401,699 | B1 | | 6/2002 | Persson et al. | 123/568.12 |
| 6,435,166 | B1 | * | 8/2002 | Sato et al. | 123/568.12 |
| 6,474,060 | B2 | * | 11/2002 | Khair | 60/278 |
| 6,474,319 | B1 | | 11/2002 | Hough et al. | 123/568.11 |

FOREIGN PATENT DOCUMENTS

| | | | | |
|---|---|---|---|---|
| JP | 11-62722 A | * | 3/1999 | 60/605.2 |
| JP | 2002-39019 A | * | 2/2002 | 60/605.2 |
| WO | WO 02099261 A1 | | 5/2002 | |

* cited by examiner

*Primary Examiner*—Willis R. Wolfe, Jr.
(74) *Attorney, Agent, or Firm*—Novak Druce & Quigg, LLP

(57) ABSTRACT

Method and arrangement for cleaning an EGR cooler of an exhaust gas recirculation system by detecting an excessive particulate accumulation condition in the EGR cooler and causing liquid-state moisture to be introduced in the EGR cooler thereby enabling a reduction of the excessive particulate accumulation from the EGR cooler. One embodiment of the present invention provides for locating a first temperature sensor after an EGR cooler of an exhaust gas recirculation system at a suitable location to detect an exit-temperature of exhaust gas leaving the EGR cooler and a second temperature sensor at a suitable location to detect a temperature of available coolant for the EGR cooler, arranging the first and second temperature sensors in communication with an automated controller adapted to execute a cleaning routine that affects a periodic reduction of particulate accumulation in the EGR cooler, and executing the cleaning routine, responsive to instructions from the automated controller, when the first temperature sensor has detected an over-threshold temperature condition and the second temperature sensor has detected an under-threshold temperature condition.

39 Claims, 3 Drawing Sheets

METHOD AND ARRANGEMENT FOR REDUCING PARTICULATE LOAD IN AN EGR COOLER

BACKGROUND OF INVENTION

1. Field of the Invention

The present invention relates generally to a method for cleaning an EGR cooler of an exhaust gas recirculation system, and more particularly to a method for cleaning an EGR cooler of an exhaust gas recirculation system that intentionally creates condensation within the EGR cooler to effectively reduce particulate buildup.

2. Background

The demand for cleaner burning internal combustion engines has continued to increase in recent years. This is largely due to the fact that internal combustion engines generally do not completely burn fuel, and in any event produce various by-products in the emitted exhaust that can be harmful to the environment. Common by-products typically include nitrous oxides, carbon monoxide, carbon dioxide, and various hydrocarbons. These by-products not only pose harm to the environment, but some represent wastefulness in that they have not been fully burned. These by-products, particularly the solid particulate matter commonly referred to as soot, can accumulate in associated systems through which they pass. Methods to simply remove these by-products have included traps of various designs, as well as filter arrangements. While methods to further burn these by-products and thus increase the level of combustion efficiency include passing the exhaust gas through afterburners, in more recent years, recirculation of at least a portion of the exhaust gas back into the air intake of the engine has been implemented and the arrangements that accomplish this recirculation are typically referred to as exhaust gas recirculation systems, or EGR system for short. The present invention is directed to such an EGR system.

An EGR system recirculates a portion of exhaust gas back into the intake of a combustion engine. This recirculation not only allows for further combustion of the exhaust by-products, but it also selectively advantageously dilutes the incoming fuel charge in the cylinders. Temperature adjustments to the combustion mixture can also be affected using the EGR system, including lowering combustion temperature which reduces certain emissions, such as nitrous oxide. To achieve a lower temperature in the otherwise high-temperature exhaust gas, the recirculated exhaust gas is typically cooled before being introduced to the intake of the engine thereby effectively lowering the ensuing combustion temperature. This process is generally accomplished through an EGR cooler. When the exhaust gas is passed through the EGR cooler, the particulate matter can adhere to the EGR cooler where it compacts and hardens over time. This accumulation reduces the cooling efficiency of the EGR cooler as the particulate accumulation effectively insulates the coolant coils, inhibiting the coolant coils from cooling the exhaust gas. From a structural perspective, the EGR cooler is interiorly configured basically as a radiator with cooling coils located therein, and through which reduced-temperature coolant is circulated. If the particulate accumulation is not addressed, it not only leads to potentially damagingly high temperatures in, and after the EGR cooler, but the restriction that the build-up poses also inhibits flow of exhaust gas being recirculated therethrough, and can even effectively cause a blockage at the EGR cooler in extreme cases. This buildup effectively shortens the service life of the EGR system, necessitating frequent and expensive cleaning of the EGR cooler to promote efficiency and prevent excessive fouling of the exhaust gas recirculation flow path. Thus a method to prevent, or at least reduce accumulation of this particulate residue in an EGR is desired.

Several methods have been developed to address the particulate accumulation problem. One such method is to simply place a filter upstream of the EGR cooler. This effectively traps a certain amount of hydrocarbon particles before they enter the EGR cooler. Such a filter is described in U.S. Pat. No. 6,474,319, issued to Hough et al. and entitled Filter System For The Removal Of Hydrocarbon Deposits From A Cooled Exhaust Gas Recirculating Engine. Such a filter system, however, not only requires the additional cost of a filter that further requires cleaning and maintenance, but also typically necessitates the use of a catalyst and/or heating means to reduce the build up of particles that inevitably occur at the filter.

Another similar method implements a carbon filter, but places a non-thermal plasma generator upstream of the filter to oxidize carbon deposited, or trapped on the filter. Such a method is disclosed in U.S. Pat. No. 6,474,060, issued to Khair and entitled Exhaust Gas Recirculation Filtration System. Again, although this method will reduce the amount of particulates entering into the EGR cooler, it still requires additional parts leading to increased expense and maintenance, and ultimately, build-up in the EGR cooler can occur.

Another attempt to alleviate the problem of particulate buildup uses a protective coating that when applied to the components of the EGR system reduces the tendency of particles to adhere to the coated region and may also reduce the risk of sulfuric acid corrosion. A protective, prophylactic coating is disclosed in PCT Publication No. WO 02/099261 entitled Protective Coating For Internal Combustion Engine Components. While this method may indeed reduce the buildup of hydrocarbons, it is unclear as to whether this coating will continue to do so after an extended length of time operating under the corrosive environment caused by hard-working diesel engines.

A well-known concern for the industry is preventing condensation from occurring within EGR systems. This is of particular concern at the EGR cooler where temperature lowering is purposely caused to the exhaust gas; and therefore, special care has been traditionally taken to assure that no condensation-forming conditions are permitted at the EGR cooler. This is largely due to the fact that fuels, for instance diesel fuel, contain a certain level of sulfur. When this sulfur combines with water resulting from condensation or otherwise, corrosive sulfuric acid is produced.

The present invention provides a solution to the problem of hydrocarbon particle buildup in an EGR cooler 18 of a standard EGR system without adding additional parts, cost and maintenance concerns, and it provides a solution that should endure over a typical life span of an internal combustion engine. Still further, the teachings of the present invention are based on tenets diametrically opposed and counter to traditional thinking within the EGR-utilizing industries, and therefore constitute and deliver surprising results.

SUMMARY OF INVENTION

A primary embodiment of the present invention provides for a method and arrangement to clean an EGR cooler of an exhaust gas recirculation system by detecting an excessive particulate accumulation condition in the EGR cooler and causing liquid-state moisture to be introduced in the EGR cooler thereby enabling a reduction of the excessive particulate accumulation from the EGR cooler.

An embodiment of the present invention further provides causing liquid-state moisture to be introduced in the EGR cooler by establishing conditions in the EGR cooler sufficient to cause condensation to form from moisture contained in exhaust gases passing through the EGR cooler thereby enabling the reduction of the excessive particulate accumulation from the EGR cooler. As an alternative, it is contemplated that liquid-state moisture can be introduced in the EGR cooler by other means than condensation formation for achieving similar results.

A further embodiment of the present invention establishes the conditions in the EGR cooler sufficient to cause condensation to form from moisture contained in exhaust gases passing through the EGR cooler by delivering coolant to the EGR cooler having a sufficiently low temperature to cause the condensation formation.

Another embodiment of the present invention specifies initiating the step of causing liquid-state moisture to be introduced in the EGR cooler after the step of detecting an excessive particulate accumulation condition in the EGR cooler.

One embodiment of the present invention contemplates establishing conditions in the EGR cooler sufficient to cause condensation to form from moisture contained in exhaust gases passing through the EGR cooler when a coolant temperature for the EGR cooler is sensed below a predetermined condensation-forming temperature.

Another embodiment of the present invention provides for initiating the step of causing condensation formation in the EGR cooler on a subsequent start-up of the combustion engine after the detection of an excessive particulate accumulation condition in the EGR cooler. The subsequent start-up of this embodiment is contemplated to include any future start-up sequence occurring after a following shut down, and not necessarily the very next start-up sequence.

Another embodiment of the present invention specifies initiating the step of causing condensation formation in the EGR cooler on the immediately next-following start-up of the combustion engine after the detection of an excessive particulate accumulation condition in the EGR cooler. The next-following start-up of the combustion engine is defined for purposes of the invention to be the next- start-up sequence after the engine has been turned off, but not necessarily for a period of time that permits the coolant temperature to sufficiently cool down enough to cause condensation formation within the EGR cooler. This embodiment contemplates the fact that most drivers will only shut-down their engines if the engine is going to be idle for at least a time period long enough to allow the engine systems to cool to ambient temperature; for instance, overnight. This can greatly simplify the implementing arrangement and control strategy for causing condensate production at the EGR cooler.

Another embodiment of the present invention specifies initiating the step of causing condensation formation in the EGR cooler on a subsequent start-up of the combustion engine after the detection of an excessive particulate accumulation condition in the EGR cooler when a coolant temperature is sensed or predicted to be below a predetermined condensation-forming temperature.

Another embodiment of the present invention contemplates permitting caused condensation to absorb into the excessive particulate accumulation and loosening its adherence from the EGR cooler. As an example of such an implementation, the control strategy can be to reduce exhaust gas flow immediately after condensation production thereby allowing the liquid-state condensation to sit with, and absorb into the particulate. Two additional aspects are accomplished by this strategy: (1) the flow of hot exhaust is reduced thereby avoiding evaporation of the just-formed condensation, and (2) the tendency to flush loosened particulate is reduced until a more thorough loosening has been accomplished by allowing the condensate to more thoroughly permeate the build-up.

An associated embodiment of that described above is that flushing of the moistened and loosened excessive particulate accumulation from the EGR cooler by the directed gas flow therethrough is ultimately caused; typically by increasing the reduced flow.

Similar to the above, another embodiment of the present invention provides for utilizing exhaust gas pressure to flush the moistened and loosened excessive particulate accumulation from, but also downstream of the EGR cooler.

Another embodiment of the present invention contemplates that forming an acid and exposing downstream components of the arrangement to the acid is a consequence of the condensation formation which is completely counter to traditional thinking in these technologies. As an adjunct, however, the present invention further contemplates a minimization of the exposure of the downstream components to the produced acid, for example, by causing condensation only when an excessive particulate load is detected or by immediately drying the condensation from the acid-exposed downstream components thereby rendering the acid less corrosively active.

Another embodiment of the present invention provides for utilizing an automated controller as part of the arrangement in a combustion engine powered vehicle to execute a cleaning routine that affects the periodic reduction of particulate accumulation in the EGR cooler of the exhaust gas recirculation system of the vehicle.

Another embodiment of the present invention provides for controlling the inlet of exhaust gas to the exhaust gas recirculation system of the vehicle by manipulating an EGR valve, via the automated controller, based on sensed conditions of the exhaust gas recirculation system.

Another embodiment of the present invention provides for sensing at least a temperature of coolant available to supply to the EGR cooler and a temperature of EGR gas after the EGR cooler.

Another embodiment of the present invention detects an excessive particulate accumulation condition on a sensed temperature after the EGR cooler exceeds a predetermined high-temperature threshold.

Another embodiment of the present invention prescribes the predetermined high-temperature threshold based on heat resistant characteristics of downstream components of the arrangement relative to the EGR cooler.

The present invention also provides for locating a first temperature sensor after an EGR cooler of an exhaust gas recirculation system at a suitable location to detect an exit-temperature of exhaust gas leaving the EGR cooler and a second temperature sensor at a suitable location to detect a temperature of available coolant for the EGR cooler, arranging the first and second temperature sensors in communication with an automated controller adapted to execute a cleaning routine that affects a periodic reduction of particulate accumulation in the EGR cooler, and executing the cleaning routine, responsive to instructions from the automated controller, when the first temperature sensor has detected an over-threshold temperature condition and the second temperature sensor has detected an under-threshold temperature condition.

Another embodiment of the present invention provides for opening an EGR valve thereby causing exhaust gas flow into the EGR cooler when conditions in the EGR cooler are sufficient to cause condensation to form from moisture contained in the exhaust gas directed therethrough.

Another primary embodiment of the present invention provides for a method and arrangement to clean an EGR cooler of an exhaust gas recirculation system by causing liquid-state moisture to be introduced in the EGR cooler thereby enabling a reduction of the excessive particulate accumulation from the EGR cooler. A fundamental difference between this primary embodiment and the one that has been described hereinabove is that this embodiment does not necessarily require a detection of excessive particulate load in the EGR cooler in order to initiate particulate-reduction routines. Otherwise, the alternative aspects defined above with respect to the first primary embodiment in which the occurrence of an excessive particulate load in the EGR cooler is detected similarly apply to this embodiment.

Strategies are further contemplated in which initiation of conditions in the EGR cooler sufficient to cause condensation to form from moisture contained in exhaust gases passing through the EGR cooler are affected upon startup of the vehicle. Optionally, initiation can be limited to start-ups of the vehicle only when a predetermined vehicle condition has been detected. One such exemplary option is limiting the initiation of steps to establish conditions in the EGR cooler sufficient to cause condensation to form from moisture contained in exhaust gases passing through the EGR cooler to cold start-ups of the vehicle. This condition can be defined as being based on situations when a coolant temperature is sensed below a predetermined condensation-forming temperature.

Unique methods and arrangements are defined above relative to the present invention(s) that serve as basis for useful and in-demand products of the several concerned industries, and especially the transportation industries that are heavily dependent on diesel powered vehicles.

BRIEF DESCRIPTION OF DRAWINGS

The foregoing and other features and aspects of the present disclosure will be best understood with reference to the following detailed description of embodiments of the invention, when read in conjunction with the accompanying drawings, wherein.

DETAILED DESCRIPTION

In the disclosure that follows, in the interest of clarity, not all features of actual implementations are described in this disclosure.

Figure 1:
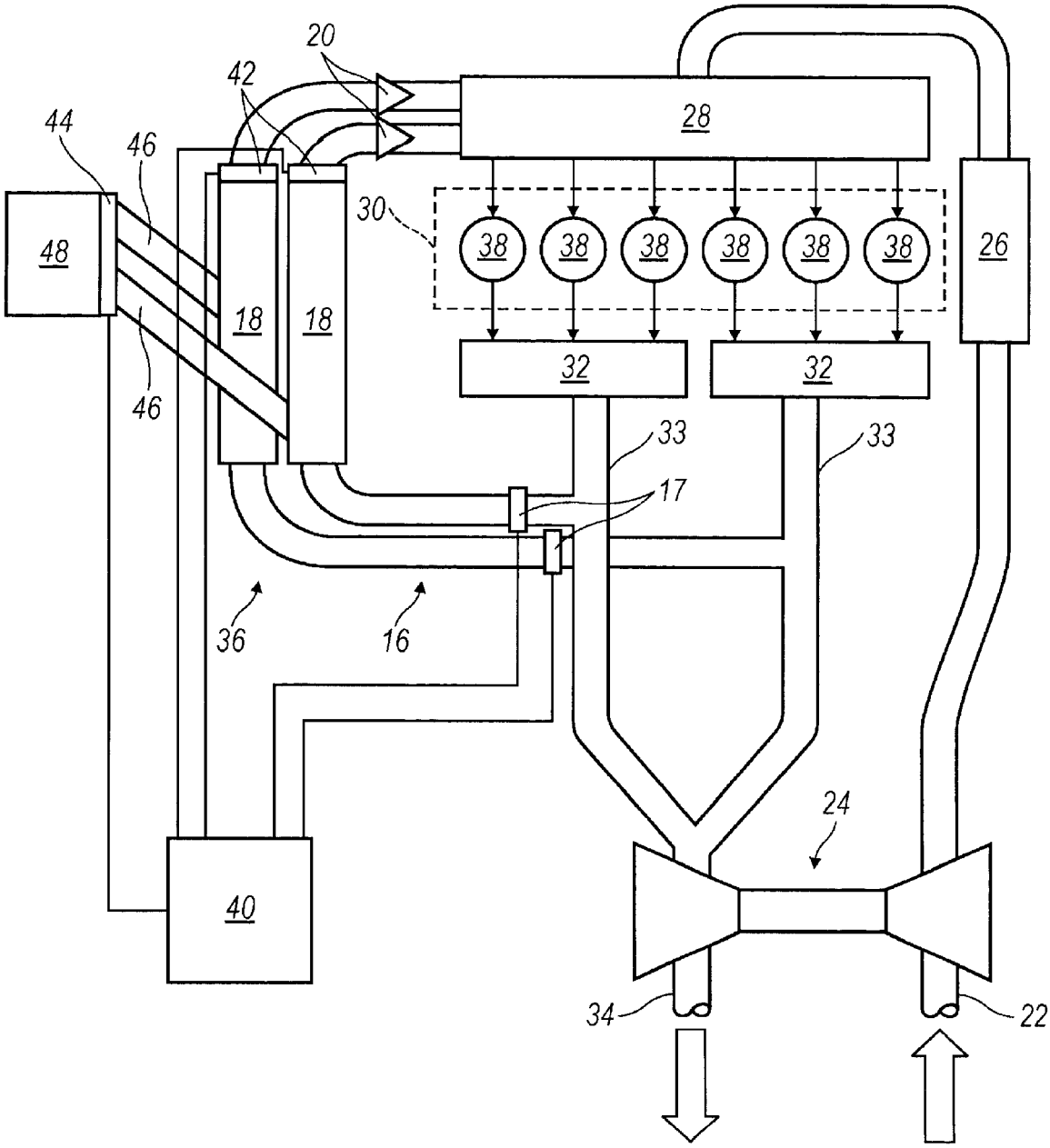
FIG. 1 is a schematic representation of an internal combustion engine incorporating an exhaust gas recirculation system configured and utilizable according to the teachings of the present invention.

The present invention provides a simple method for cleaning an EGR cooler 18 by purposefully causing condensation within the cooler for a limited and controlled amount of time. An EGR system is illustrated in FIG. 1 and described briefly below to aid in the understanding and conception of the present invention. In FIG. 1, an internal combustion engine incorporating an EGR system 36 is illustrated similar to that disclosed in U.S. Pat. No. 6,401,699 entitled Combustion Engine Arrangement, and which is expressly incorporated herein by reference in its entirety. Initially, outside air is introduced into the engine through an inlet 22. This air may preferably be cooled before entering the inlet air manifold 28 by a charge air cooler 26, as is known in the art, to improve the efficiency of the combustion process. From the inlet air manifold 28, the air then enters into cylinders 38 of an engine where it is combined with injected fuel for combustion. As shown, but of course not necessary for the present invention, the cylinders 38 operate synchronously in groups of three. In other words, the first group of three cylinders 38 cycle in a timed sequence that is counter to the timed sequence of the second group of three cylinders 38 such that high-pressure pulses are generated alternately between each group of cylinders 38. From the cylinders 38, the alternating high-pressure pulses flow through the corresponding exhaust manifold 32 and then exit through the corresponding exhaust outlet 33. A turbo unit 24, which typically includes a turbine and a compressor, may preferably be located just after the exhaust outlets 33 to recapture a portion of the energy of the exhaust gas before it is released into the environment by way of the outlet pipe 34.

The EGR system 36 also captures a portion of the energy of the exhaust gas through an EGR bypass 16, one each fluidly connected to the respective exhaust outlets 33. A controller 40 permits the flow of exhaust gas to enter into each EGR bypass 16 by selectively opening controllable valves 17, depending on the given operating parameters. The gas entering from the exhaust outlets 33 into the EGR bypass 16 is quite high in temperature so an EGR cooler 18, as is known, is necessary to cool this exhaust gas before recirculating it back into the inlet air manifold 28. By cooling the exhaust gas, the combustion temperature is decreased resulting in more efficient fuel utilization and a decrease in emissions from the engine. An inevitable consequence of cooling the exhaust gas is that the residual hydrocarbon and other particulates will adhere to and accumulate within the EGR cooler 18. When this build up occurs, the coolant coils are effectively insulated leading to a decrease in cooling efficiency by the EGR cooler 18 and resulting in an increase in the temperature of the exhaust exiting the EGR cooler 18. This increase in temperature may present a significant problem to the various temperature sensitive components such as the one-way valves 20 located downstream of the EGR cooler 18 when the exhaust temperature exceeds a threshold level.

The one-may comprise any of several known valve types, such as a reed-type valve, which allows the EGR system 36 to capture the power generated from the alternating high-pressure pulses from the cylinders 38. High pressure is needed within the EGR bypass 16 to overcome the biased position of the one-way valve opening the valve to allow for fluid to enter into the intake air manifold 28. In other words, at least the peaks of the high-pressure pulses should have a pressure that is higher than the pressure existing downstream of the one-way valve 20. Thus when the one-way valve 20 opens the re-circulated exhaust gas is effectively forced into the inlet air manifold 28. Such a design as shown in FIG. 1 is known as a high-pressure loop EGR system. Of course, the present invention is not limited in any way for use only with such a high-pressure loop EGR system, but may also be used effectively with a low-pressure loop EGR system such as found when the EGR bypass connects with the outlet pipe 34 at a location downstream of the turbo unit 24.

Because of the sensitivity of the one-way valve 20 to temperature and the desire to maintain the capability of the one-way valve 20 to effectively capture the high-pressure pulses for the EGR system 36 to operate, damage to the one-way valve 20 should be avoided. High temperatures can also affect EGR Cooler efficiency, so to monitor the temperature conditions, the EGR system 36 preferably includes temperature sensors 42 for monitoring the temperature of the exhaust gas flowing from the EGR cooler 18. By sending these temperature measurements to the controller 40, the controller 40 can effectively monitor for when conditions have been exceeded that can potentially cause damage to downstream components, including the one-way valve 20. If for example the temperature sensors 42 measure an over-threshold temperature condition, such as 200° C., the controller 40 may respond by closing the controllable valves 17. By communicating with the temperature sensors 42, the controllable valves 17, and the coolant temperature sensors 44 discussed in more detail below, the controller 40 can not only reduce the risk of harm to these downstream components, but can also be used to reduce the particulate accumulation occurring within the EGR cooler 18 by implementing the cleaning method described in further detail below.

The cleaning method of the present invention purposefully causes an introduction of liquid into the EGR cooler 18, preferably by causing condensation formation within the EGR cooler 18 so that the build up of hydrocarbon and other particulate residue is loosened and can then be expelled by the exhaust gas out of the EGR cooler 18. A heretofore governing tenet of such EGR designs is to purposefully avoid the production of condensation. This is largely due to the fact that diesel fuel contains a measurable amount of sulfur, and when the sulfur combines with water, sulfuric acid is produced. Sulfuric acids such as $HSO_3$ and $H_2SO_4$ are very corrosive.

Because of the risk of creating sulfuric acid, conditions that are favorable for condensation have heretofore been avoided in the technology. Largely, the industry has accomplished this by only operating the EGR system 36 when the risk of condensation is low. The coolant temperature in the EGR cooler 18 can be measured by coolant temperature sensors 44 which may be located at the coolant supply unit 48, anywhere along the coolant supply lines 46 or even within the EGR cooler 18 itself. Typically, when this coolant measures 25° C. to 65° C., the EGR cooler 18 operates most efficiently. This is because at this temperature range the greatest temperature differential between the coolant fluid and the exhaust temperature occurs. However, this is also the temperature range where the greatest risk for condensation exists within the EGR cooler 18. Thus, it is standard practice within the art to close the controllable valves 17, effectively disengaging the EGR system 36, at temperatures within this condensation forming range or under this threshold temperature condition. When the coolant temperature rises above this threshold temperature, generally above 65° C., the controller 40 opens the controllable valves 17 allowing the influx of exhaust gases into the EGR bypass 16. The flow of exhaust gas may be altered and adjusted depending on the efficiency desired, the current environmental conditions, humidity and engine load.

Figure 2:
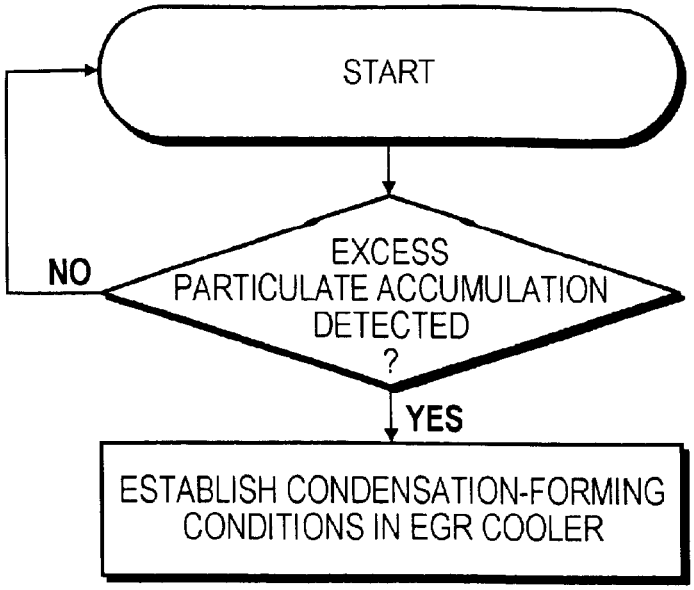
FIG. 2 is a block diagram illustrating a method of cleaning an EGR cooler of an exhaust gas recirculation system according to one embodiment of the present invention.
Figure 3:
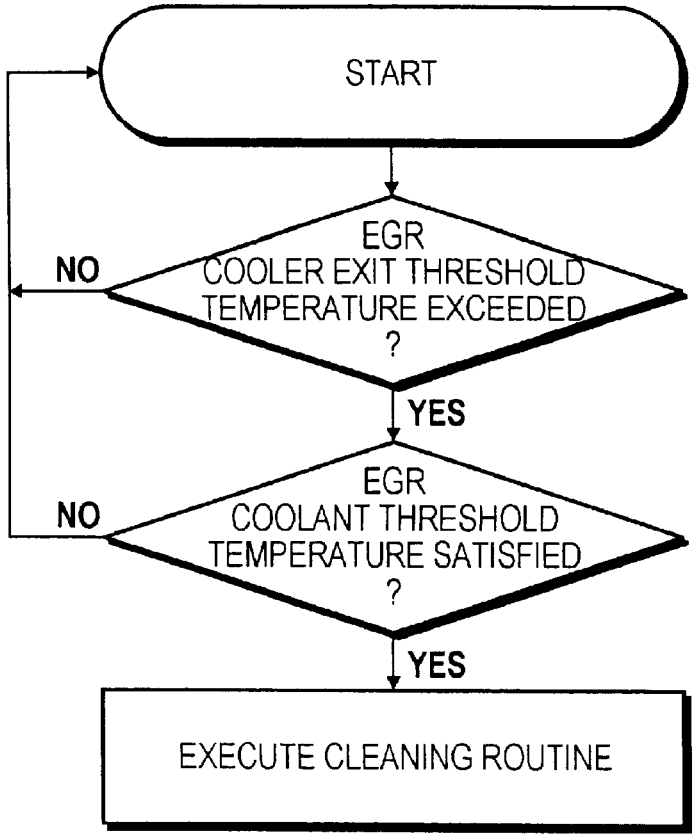
FIG. 3 is a block diagram illustrating a method of cleaning an EGR cooler of an exhaust gas recirculation system according to another embodiment of the present invention.
Figure 4:
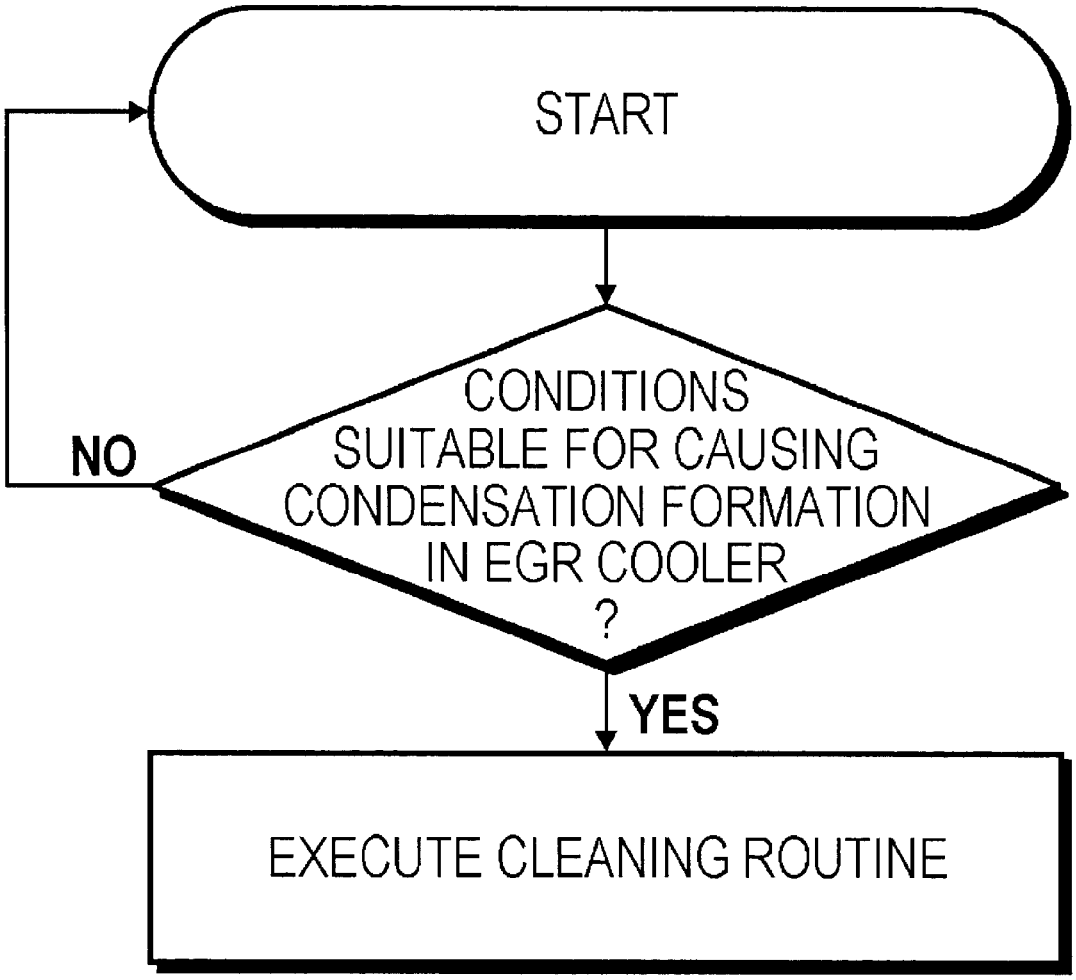
FIG. 4 is a block diagram illustrating a method of cleaning an EGR cooler of an exhaust gas recirculation system according to yet another embodiment of the present invention.

Embodiments of the present invention are illustrated in FIGS. 2, 3 and 4. As illustrated in FIG. 2, the controller 40 makes an initial determination of whether there is excess particulate accumulation within the EGR cooler 18. One method of determining excess particulate accumulation is by monitoring the temperature sensors 42 for measurements exceeding the threshold temperature, such as 200° C. or above, however, as one skilled in the art will realize various other methods of determining particulate buildup may be utilized. When the controller 40 determines that excessive particulate accumulation has occurred the controller 40 will then establish conditions favorable for condensation formation within the EGR cooler 18. One method of establishing these conditions is by monitoring the coolant temperature sensors 44 for temperatures falling within the condensation forming range, such as between 25° C. and 65° C. When the coolant temperature subsequently falls within this range, the controller 40 will open the controllable valves 17. The controller 40 may preferably open the controllable valves 17 immediately upon the next occurrence of a condensation-forming temperature, or upon any other subsequent occurrence. When condensation has formed within the EGR cooler 18, the hardened residue is softened and will loosen from its grip within the EGR cooler 18. Once loosened the hot exhaust gases can expel the softened mixture through the EGR cooler 18 and out of the entire EGR system 36 itself.

As demonstrate in FIG. 3, the controller 40 may simply monitor the temperature exiting the EGR cooler 18 without making a determination as to whether there has been excess particulate accumulation. If the temperature exiting the EGR cooler exceeds the threshold temperature, then the cleaning routine is implemented. Another embodiment of the present invention is illustrated in FIG. 4, where the controller 40 simply monitors for conditions that are suitable for causing condensation formation within the EGR cooler. When those conditions are found, the controller 40 may then implement the cleaning routine or periodically implement the cleaning routine.

The cleaning procedure of the present invention may be stored within the controller 40 in computer readable memory for the controller 40 to execute. The controller 40 preferably communicates with at least the controllable valves 17, the temperature sensors 42 and the coolant temperature sensors 44 to implement the present invention. The controller 40 opens the controllable valves 17 for a limited, predetermined length of time while the temperature of the coolant is cold enough to cause condensation. For this length of time, such as for example about 10 minutes, the hydrocarbon residue is softened and allowed to expel through the EGR system 36. Immediately thereafter, the controller 40 closes the controllable valves 17 until the coolant temperature rises above the condensation forming temperature and the risk of further condensation is eliminated. The predetermined length of time, may of course be varied in order to limit the amount of condensation and the length of time the condensation is allowed to remain within the EGR system 36 according to the particular engine and EGR system 36 requirements and according to the content of the sulfur within the diesel fuel itself. As previously discussed, when sulfur mixes with water corrosive sulfuric acid is formed so the length of time that the components of the EGR system 36 are exposed to this sulfuric acid should be necessarily minimized.

The present invention minimizes the exposure to sulfuric acid in a couple of ways. First the present invention is implemented upon excessive buildup of particulate accumulation. As previously mentioned, this excessive particulate accumulation may be detected when the temperature sensors 42 measure a temperature above the threshold level. In one embodiment, it is only then that the controller 40 will execute the cleaning routine and open the controllable valves 17 when the coolant temperature falls within the condensation forming temperature range. Another mechanism for minimizing the exposure to sulfuric acid is by limiting the amount of time that the controllable valves 17 are open during condensation. This time is adjusted such that the corrosion risk is acceptable depending on the humidity levels and temperature levels, which the controller 40 may continuously monitor. Thus, although the present invention exposes the EGR cooler 18 and downstream components of the EGR system 36 to sulfuric acid, it has been found that by limiting this exposure in the above manner, the amount of exposure is acceptable and will not produce any substantial harmful risk.

The foregoing description of preferred and other embodiments is not intended to limit or restrict the scope or applicability of the inventive concepts conceived of by the Applicant. It is intended that the invention include all modifications and alterations to the full extent that they come within the scope of the following claims or the equivalents thereof. For example, as one familiar with the art will recognize increasingly stringent EPA standards are reducing the amount of sulfur found within diesel fuel. One can imagine that when these levels are reduced to a sufficient level the present invention may be implemented on a more frequent basis as the risk of producing any significant amount of sulfuric acid is minimized.

What is claimed is:

1. A method for cleaning an EGR cooler of an exhaust gas recirculation system, comprising:

utilizing an arrangement in a combustion engine powered vehicle to enable periodic reduction of particulate accumulation in an EGR cooler of an exhaust gas recirculation system of the vehicle;

detecting an excessive particulate accumulation condition in the EGR cooler;

causing liquid-state moisture to be introduced in the EGR cooler thereby enabling a reduction of the excessive particulate accumulation from the EGR cooler and wherein the step of causing liquid-state moisture to be introduced in the EGR cooler further comprises establishing conditions in the EGR cooler sufficient to cause condensation to form from moisture contained in exhaust gases passing through the EGR cooler.

2. The method of claim 1, wherein the step of establishing conditions in the EGR cooler sufficient to cause condensation to form from moisture contained in exhaust gases passing through the EGR cooler further comprises delivering coolant to the EGR cooler having a sufficiently low temperature to cause condensation to form from moisture contained in the exhaust gases passing through the EGR cooler.

3. The method of claim 1, further comprises:

initiating the step of causing liquid-state moisture to be introduced in the EGR cooler after the step of detecting an excessive particulate accumulation condition in the EGR cooler.

4. The method of claim 1, further comprises:

initiating the step of causing liquid-state moisture to be introduced in the EGR cooler when a coolant temperature is sensed below a predetermined condensation-forming temperature.

5. The method of claim 1, further comprises:

initiating the step of causing liquid-state moisture to be introduced in the EGR cooler on a subsequent start-up of the combustion engine after the detection of an excessive particulate accumulation condition in the EGR cooler.

6. The method of claim 1, further comprises:

initiating the step of causing liquid-state moisture to be introduced in the EGR cooler on an immediately next-following start-up of the combustion engine after the detection of an excessive particulate accumulation condition in the EGR cooler.

7. The method of claim 1, further comprises:

initiating the step of causing liquid-state moisture to be introduced in the EGR cooler on a subsequent start-up of the combustion engine after the detection of an excessive particulate accumulation condition in the EGR cooler when a coolant temperature is sensed below a predetermined condensation-forming temperature.

8. The method of claim 1, further comprises:

permitting caused condensation to absorb into the excessive particulate accumulation thereby loosening adherence of the excessive particulate accumulation from the EGR cooler.

9. The method of claim 8, further comprises:

flushing the moistened and loosened excessive particulate accumulation from the EGR cooler.

10. The method of claim 9, further comprises:

utilizing exhaust gas pressure to flush the moistened and loosened excessive particulate accumulation from, and downstream of the EGR cooler.

11. The method of claim 1, further comprising:

forming an acid as a consequence of the causation of condensation; and exposing downstream components of the arrangement to the acid.

12. The method of claim 11, further comprising:

minimizing the exposure of the downstream components to the acid.

13. The method of claim 12, wherein the step of minimizing the exposure comprises causing condensation only when an excessive particulate load is detected.

14. The method of claim 12, wherein the step of minimizing the exposure comprises immediately drying condensation from the acid-exposed downstream components thereby rendering the acid less corrosively active.

15. The method of claim 1, further comprising:

utilizing an automated controller as part of the arrangement in a combustion engine powered vehicle to execute a cleaning routine that affects the periodic reduction of particulate accumulation in the EGR cooler of the exhaust gas recirculation system of the vehicle.

16. The method of claim 15, further comprising:

controlling the inlet of exhaust gas to the exhaust gas recirculation system of the vehicle by manipulating an EGR valve, via the automated controller, based on sensed conditions of the exhaust gas recirculation system.

17. The method of claim 16, further comprising:

sensing at least a temperature of coolant available to supply to the EGR cooler and a temperature after the EGR cooler.

18. The method of claim 1, further comprising:

basing the detection of an excessive particulate accumulation condition in the EGR cooler on a sensed temperature after the EGR cooler exceeding a predetermined high-temperature threshold.

19. The method of claim 18, further comprising:

prescribing the predetermined high-temperature threshold based on heat resistant characteristics of downstream components of the arrangement relative to the EGR cooler.

20. A method for cleaning an EGR cooler of an exhaust gas recirculation system in a vehicle, comprising:

locating, in an exhaust gas recirculation system adapted vehicle, a first temperature sensor after an EGR cooler of the system at a suitable location to detect an exit-temperature of exhaust gas leaving the EGR cooler and a second temperature sensor at a suitable location to detect a temperature of available coolant for the EGR cooler;

arranging the first and second temperature sensors in communication with an automated controller adapted to execute a cleaning routine that affects a periodic reduction of particulate accumulation in the EGR cooler; and executing the cleaning routine, responsive to instructions from the automated controller, when the first temperature sensor has detected an over-threshold temperature condition and the second temperature sensor has detected an under-threshold temperature condition.

21. The method of claim 20, further comprising:

causing condensation to form from moisture contained in exhaust gases passing through the EGR cooler thereby enabling a reduction of particulate accumulation from the EGR cooler when the condensation mixes with, and loosens particulate adhering to the EGR cooler.

22. The method of claim 20, wherein said step of executing the cleaning routine further comprises:

opening an EGR valve thereby causing exhaust gas flow into the EGR cooler when conditions in the EGR cooler are sufficient to cause condensation to form from moisture contained in the exhaust gas directed therethrough.

23. A method for cleaning an EGR cooler of an exhaust gas recirculation system in a vehicle, comprising:

utilizing an arrangement in a combustion engine powered vehicle to enable periodic reduction of particulate accumulation in an EGR cooler of an exhaust gas recirculation system of the vehicle;

causing liquid-state moisture to be introduced in the EGR cooler thereby enabling a reduction of the excessive particulate accumulation from the EGR cooler and wherein the step of causing liquid-state moisture to be introduced in the EGR cooler further comprises establishing conditions in the EGR cooler sufficient to cause condensation to form from moisture contained in exhaust gases passing through the EGR cooler.

24. The method of claim 23, wherein the step of establishing conditions in the EGR cooler sufficient to cause condensation to form from moisture contained in exhaust gases passing through the EGR cooler further comprises delivering coolant to the EGR cooler having a sufficiently low temperature to cause condensation to form from moisture contained in the exhaust gases passing through the EGR cooler.

25. The method of claim 23, further comprises:

initiating the step of establishing conditions in the EGR cooler sufficient to cause condensation to form from moisture contained in exhaust gases passing through the EGR cooler upon start-up of the vehicle.

26. The method of claim 25, further comprises:

initiating the step of establishing conditions in the EGR cooler sufficient to cause condensation to form from moisture contained in exhaust gases passing through the EGR cooler upon start-up of the vehicle only when a predetermined vehicle condition has been detected.

27. The method of claim 23, further comprises:

initiating the step of establishing conditions in the EGR cooler sufficient to cause condensation to form from moisture contained in exhaust gases passing through the EGR cooler upon cold start-ups of the vehicle.

28. The method of claim 27, further comprises:

initiating the step of establishing conditions in the EGR cooler sufficient to cause condensation to form from moisture contained in exhaust gases passing through the EGR cooler upon start-up of the vehicle only when a predetermined vehicle condition has been detected.

29. The method of claim 28, further comprises:

initiating the step of causing liquid-state moisture to be introduced in the EGR cooler when a coolant temperature is sensed below a predetermined condensation-forming temperature.

30. The method of claim 23, further comprises:

initiating the step of causing liquid-state moisture to be introduced in the EGR cooler on a subsequent start-up of the combustion engine after detection of an excessive particulate accumulation condition in the EGR cooler.

31. The method of claim 23, further comprises:

permitting caused condensation to absorb into the particulate accumulation in the EGR cooler thereby loosening adherence of at least a portion of the particulate accumulation from the EGR cooler.

32. The method of claim 31, further comprises:

flushing at least a portion of the moistened and loosened particulate accumulation from the EGR cooler.

33. The method of claim 32, further comprises:

utilizing exhaust gas pressure to flush the moistened and loosened excessive particulate accumulation from, and downstream of the EGR cooler.

34. The method of claim 23, further comprising:

forming an acid as a consequence of the causation of condensation; and exposing downstream components of the arrangement to the acid.

35. The method of claim 34, further comprising:

minimizing the exposure of the downstream components to the acid.

36. The method of claim 23, further comprising:

utilizing an automated controller as part of the arrangement in a combustion engine powered vehicle to execute a cleaning routine that affects the periodic reduction of particulate accumulation in the EGR cooler of the exhaust gas recirculation system of the vehicle.

37. The method of claim 36, further comprising:

controlling the inlet of exhaust gas to the exhaust gas recirculation system of the vehicle by manipulating an EGR valve, via the automated controller, based on sensed conditions of the exhaust gas recirculation system.

38. The method of claim 36, further comprising:

sensing at least a temperature of coolant available to supply to the EGR cooler.

39. The method of claim 36, further comprising:

sensing at least a temperature of the exhaust gases after the EGR cooler.

* * * * *